US006132229A

United States Patent [19]

Wu

[11] Patent Number: 6,132,229

[45] Date of Patent: Oct. 17, 2000

[54] CARD CONNECTOR

[75] Inventor: Ku-Tsan Wu, Tu-Chen, Taiwan

[73] Assignee: Hon Hai Precision Ind. Co., Ltd., Taipei Hsien, Taiwan

[21] Appl. No.: 09/187,662

[22] Filed: Nov. 5, 1998

[30] Foreign Application Priority Data

Nov. 6, 1997 [TW] Taiwan ..... 86218839

[51] Int. Cl.[7] ..... H01R 13/635

[52] U.S. Cl. ..... 439/188

[58] Field of Search ..... 439/489, 188, 439/259, 260, 159, 490

[56] References Cited

U.S. PATENT DOCUMENTS

| | | | |
|---|---|---|---|
| 5,330,363 | 7/1994 | Gardner et al. | 439/188 |
| 5,334,034 | 8/1994 | Reichardt et al. | 439/188 |
| 6,004,155 | 12/1999 | Wu | 439/489 |

*Primary Examiner*—Brian Sircus
*Assistant Examiner*—Son V. Nguyen

[57] ABSTRACT

An electrical card connector (1) has a dielectric housing (10) defining a slot (100) for receiving an electrical card therein and a number of contact passageways (101) fixedly receiving a number of reading contacts (11) therein, and a switch (12) for detecting insertion of the card. Each contact (11) has a contact portion (111) extending into the slot (100) for electrically connecting with the inserted card and a tail portion (112) extending beyond a rear side of the housing (10) for being soldered to a printed circuit board (PCB). The switch (12) consists of first and second conductive plates (121, 122) each having a tail portion connecting with the PCB and a third conductive plate (123) sandwiched between the first and second conductive plates (121, 122) when a card is not inserted into the connector (1), whereby the first and second conductive plates (121, 122) are electrically connected with each other. When a card is inserted into the connector (1), the third conductive plate (123) together with the second conductive plate (122) are pushed away from the first conductive plate (121), during which the second conductive plate (122) generates a reactive spring force larger than that generated by the third conductive plate (123).

11 Claims, 6 Drawing Sheets

CARD CONNECTOR

BACKGROUND OF THE INVENTION

1. Field of The Invention

The present invention relates to a card connector, and particularly to an improved switch structure for a smart card connector.

2. The Prior Art

Following the development of electronic technology, a variety of electronic cards such as smart cards and SIM (Subscriber Identity Module) cards are becoming increasingly popular. A variety of connectors have been designed to electrically connect such cards to mainframes, such as those disclosed in U.S. Pat. Nos. 4,735,578, 4,752,234, 4,900,272, 4,900,273, 5,013,255, 5,334,034, 5,370,544, and 5,380,997, each of which is equipped with a switch for detecting insertion of an electronic card thereinto.

FIGS. 5 and 6 show a card connector 2 in accordance with U.S. Pat. No. 5,013,255 which includes a dielectric housing 20 defining two contact receiving regions 201, a slot 203 for receiving an electrical card (not shown) into the connector 2, and a stop wall 202 which engages with the inserted card when it reaches its final inserted position, a number of reading contacts 21 fixedly received in the regions 201, each reading contact 21 having a curved contact portion 212 for electrically connecting with the inserted electrical card and a tail portion 214 for being soldered to a printed circuit board (PCB, not shown), and a switch 22 consisting of a first switch member 220 and a second switch member 23 which electrically connect with each other when no card is inserted into the connector 2, as shown in FIG. 5. The first and second switch members 220, 23 have tails 222, 232 for being soldered to the PCB, respectively. When an electrical card is inserted into the connector 2 and reaches the final inserted position, it pushes a ridge 223 of the first switch member 220 rearwards causing it to disengage from the second switch member 23, as shown in phantom lines in FIG. 6, whereby an insertion of a card into the connector 2 is detected. When the card is withdrawn from the connector 2, the first switch member 220 returns to its original position due to its resiliency to re-engage with the second switch member 23 whereby a card is not detected in the connector 2.

Since the first switch member 220 returns to its original position due to its resiliency and the connector 2 may be used extensively, after a period of use the first switch member 220 may be fatigued so that it can no longer return to its original position to positively engage with the second switch member 23. When this happens, the connector 2 does not work properly.

Hence, an improved card connector is needed to eliminate the above mentioned defects of current card connectors.

SUMMARY OF THE INVENTION

Accordingly, an objective of the present invention is to provide a card connector with a switch for detecting the insertion of an electrical card into the connector wherein the switch is reliable and durable.

To fulfill the above mentioned objective, according to one embodiment of the present invention, an electrical card connector consists of a dielectric housing defining a slot for receiving a card, a number of contact passageways fixedly receiving a number of reading contacts therein, each contact having a contact portion for electrically connecting with an inserted card and a tail portion for being soldered to a PCB on which the connector is mounted, a stop wall for limiting the final position of the inserted card, and a switch for detecting the existence of a card in the connector. The switch includes a first conductive plate having an end fixed to the housing, a free end extending in a first direction toward a middle of the housing, and a tail extending from the fixed end for being soldered to the PCB. A second conductive plate has an end fixed to the housing, a free end extending in the first direction toward the middle of the housing, and a tail extending from the fixed end for being soldered to the PCB. A third conductive plate has an end fixed to the housing, a free end extending in a direction opposite the first direction toward the middle of the housing to be sandwiched between the first and second contacts and electrically connect therewith when a card is not inserted into the connector. The third conductive plate has an engaging tab extending into the slot. When a card is inserted into the connector the second and third conductive plates disengage from the first conductive plate. During the disengagement of the second and third conductive plates from the first conductive plate, the second conductive plate generates a reactive spring force which is larger than the force generated by the third conductive plate. Thus, when the card is withdrawn from the connector, the second and third conductive plates return to their original positions even if the connector has been used for an extended period of time.

DETAILED DESCRIPTION OF THE PREFERRED EMBODIMENT

Reference will now be made in detail to the preferred embodiments of the present invention.

Figure 1:
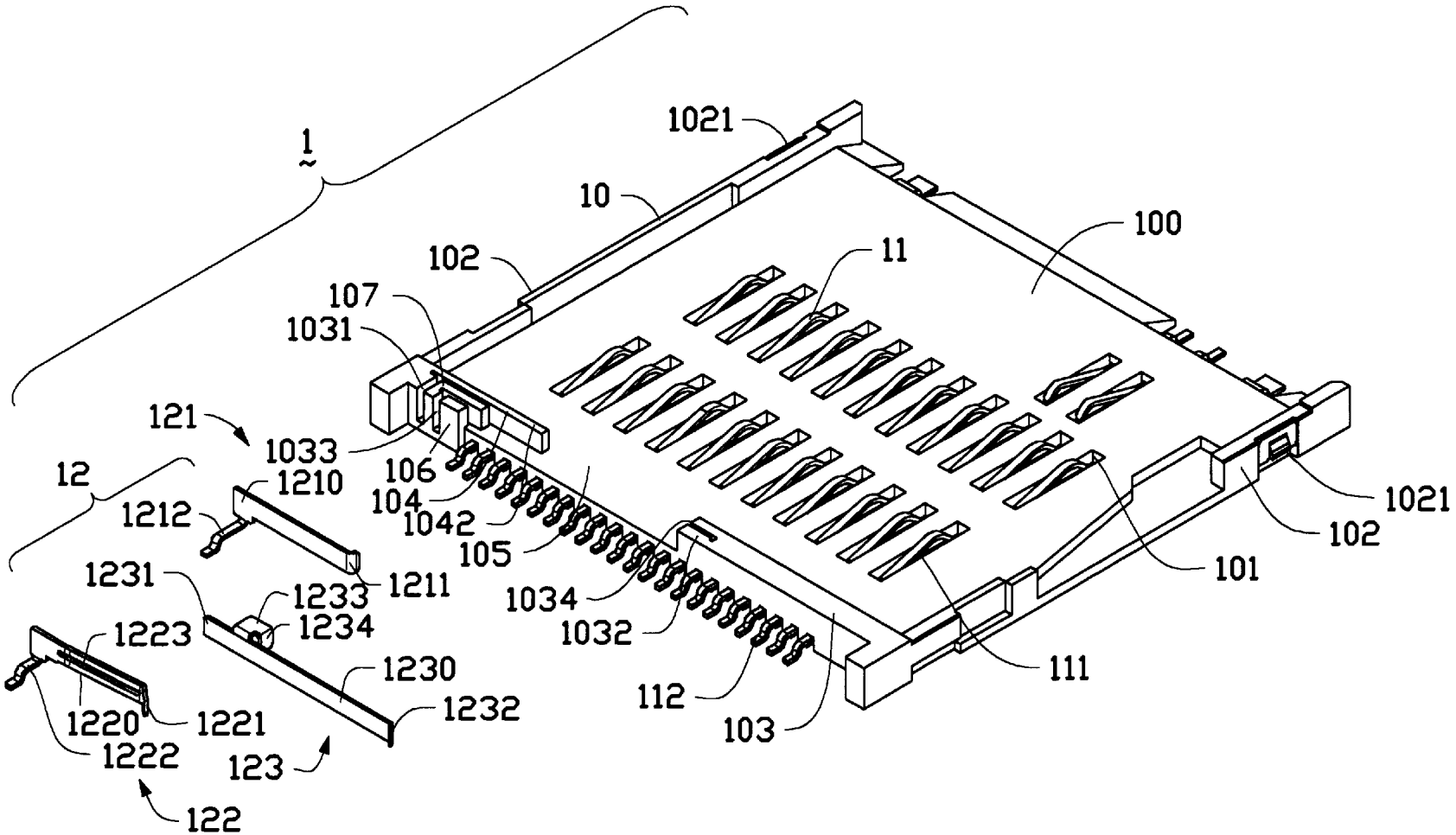
FIG. 1 is a perspective exploded view of a card connector in accordance with a first embodiment of the present invention.
Figure 2:
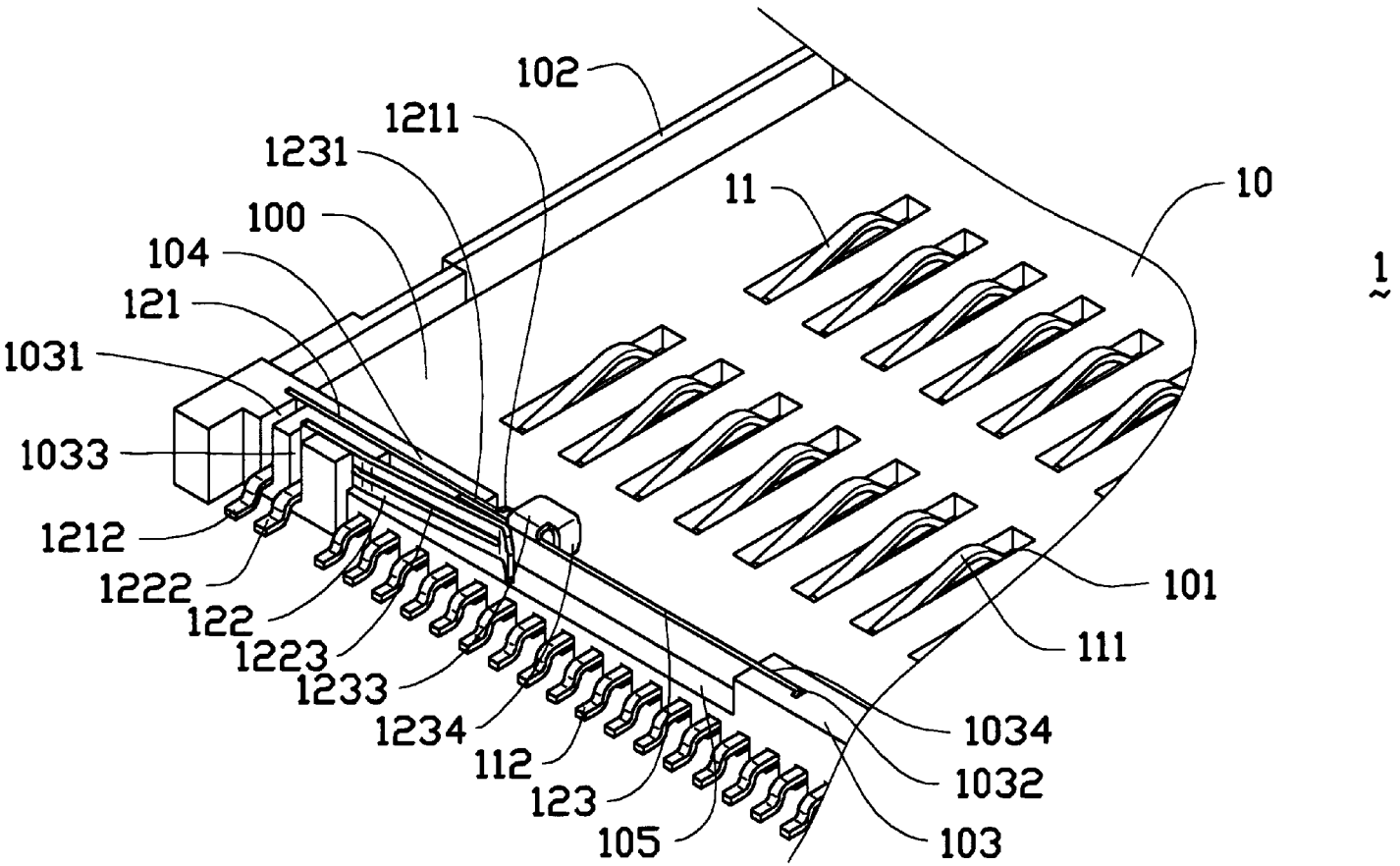
FIG. 2 is an enlarged perspective view of a left-rear corner of the connector of FIG. 1.
Figure 3:
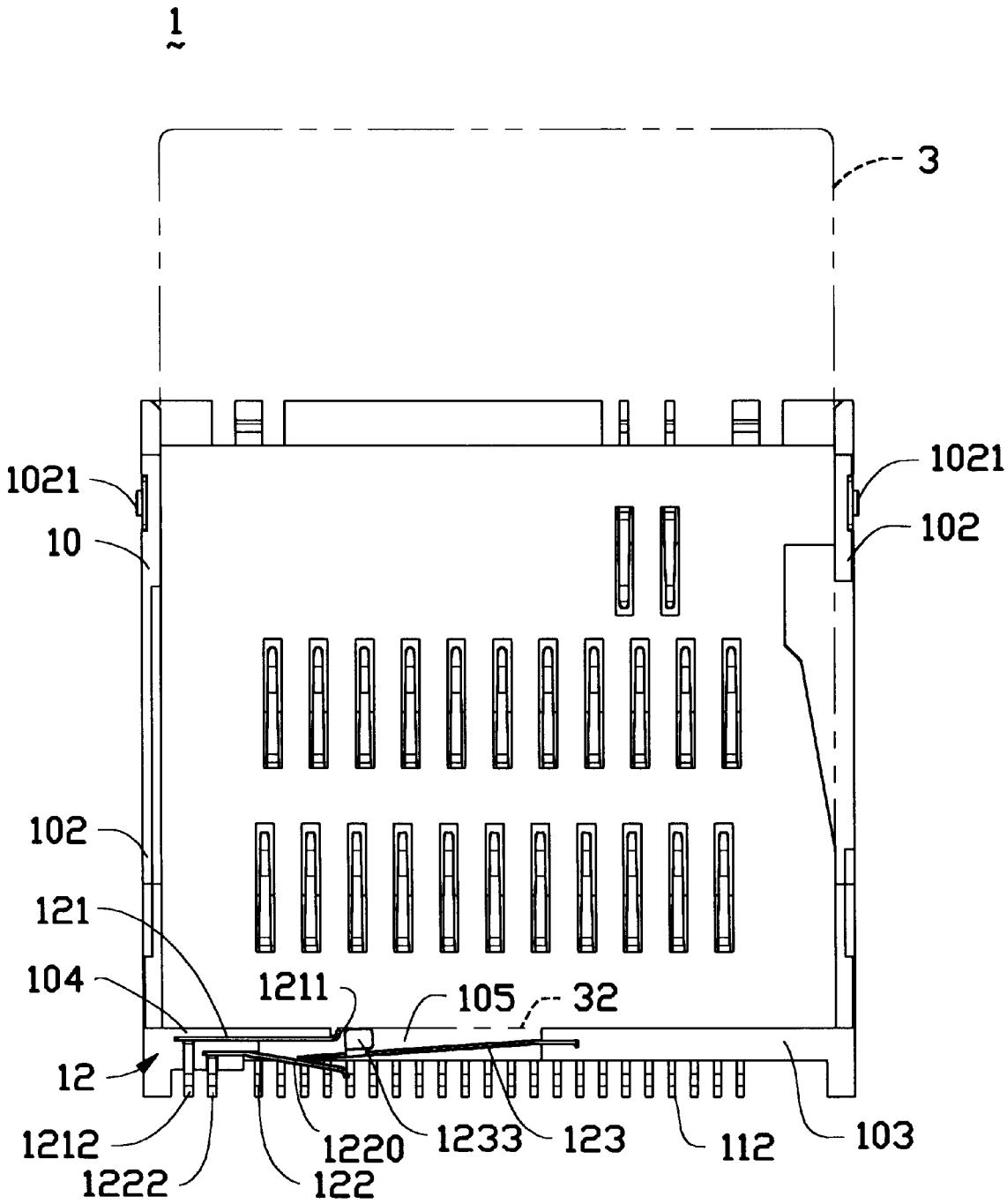
FIG. 3 is a top elevational view of FIG. 1 with an electrical card inserted into the connector.

FIGS. 1 to 3 show a card connector 1 in accordance with a first embodiment of the present invention which includes a dielectric housing 10 defining a number of contact passageways 101 receiving a number of reading contacts 11 therein. A metallic shielding (not shown for clarity) is used to enclose the contacts 11 by retentively engaging with two hooks 1021 on two lateral guiding walls 102 of the housing 10 thereby preventing electromagnetic noise from affecting the connector 1.

Each reading contact 11 has a curved contact portion 111 projecting into a slot 100 defined in the housing 10 between the lateral guiding walls 102 for receiving an inserted card (not shown) therein, and a tail portion 112 for being soldered to a printed circuit board (not shown) on which the connector 1 is mounted. First and second stop walls 103, 104 are formed in a rear side of the housing 10 and define an opening 105 therebetween. The stop walls 103, 104 function to limit the final position that the electrical card can be inserted into the connector 1 by engaging with a front end of the inserted card. The first and second stop walls 103, 104 respectively have proximal ends (not labeled) connecting with the corresponding lateral guiding walls 102 and distal ends 1032, 1042 facing each other. The distal end 1032 of the stop wall 103 defines a substantially L-shaped slit 1034 therein. An L-shaped partition 107 is located behind the second stop wall 104 to define a first L-shaped channel 1031 therebetween, and a rectangular wall 106 is located behind the L-shaped partition 107 to define a second L-shaped channel 1033 therebetween.

A switch 12 consists of first, second and third conductive plates 121, 122 and 123. The first conductive plate 121 has an elongate body 1210 with a forwardly bent free end 1211 and a tail 1212 rearwardly extending from a bottom of the opposite end. The first conductive plate 121 is interferentially received in the first channel 1031 at a position where the tail portion 1212 rearwardly extends beyond a rear side of the housing 10, the body 1210 abuts a rear face of the second stop wall 104 and the bent free end 1211 extends parallel to an edge of the distal end 1042 of the second stop wall 104.

The second conductive plate 122 is formed to have an elongate body 1220 with a slit 1223 defined therein, a rearwardly bent free end 1221 and a tail portion 1222 extending from a bottom of the opposite end. The second plate 122 is interferentially received in the second channel 1033 at a position where the tail portion 1222 rearwardly extends beyond the rear side of the housing 10 and the body 1220 extends toward the body 1210 of the first plate 121. The provision of the slit 1223 increases the resiliency of the second plate 122.

The third conductive plate 123 is formed to have an elongate body 1230 with a card engaging tab 1233 forwardly extending from an upper edge of the body 1230 near a free end 1231 thereof and a rearwardly bent end 1232 opposite the free end 1231. The card engaging tab 1233 has a leg 1234 downwardly extending therefrom. The third conductive plate 123 is mounted to the housing 10 by interferentially fitting the bent end 1232 into the L-shaped slit 1034.

When a card is not inserted into the connector 1, as best seen in FIG. 2, the first plate 121 electrically connects with the second plate 122 via the free end 1231 of the third plate 123 whereby a detecting circuit in electrical connection with the tail portions 1212, 1222 will indicate that no card is received in the connector 1. When a card is not inserted into the connector 1, the engaging tab 1233 extends a distance through the opening 105 and into the slot 100.

As best seen in FIG. 3, when an electrical card 3 is fully inserted into the connector 1 whereby its front edge 32 abuts the stop walls 103, 104, the front edge 32 pushes the leg 1234 of the engaging tab 1233 of the third conductive plate 123 rearward to cause the free end 1231 thereof to disengage from the first conductive plate 121. Meanwhile, the body 1220 of the second conductive plate 122 is pushed rearward by the third conductive plate 123. In this situation, the first and second conductive plates 121, 122 do not electrically connect with each other, therefore, the detecting circuit indicates that a card is fully inserted into the connector 1. When the engaging tab 1233 is pushed rearward by the card 3 inserted into the connector 1, the second conductive member 202 generates a reactive spring force which is larger than the force generated by the third conductive member 203.

When the card 3 is withdrawn from the connector 1, the third conductive plate 123 returns to its original position not only by its resilience but also by a push force generated by the resilience of the second conductive plate 212 which, as mentioned above, has an enhanced resilience due to the provision of the slit 1223 therein. Thus, the second and third conductive plates 122, 123 will resume their respective original positions even after repeated use of the connector.

Figure 4:
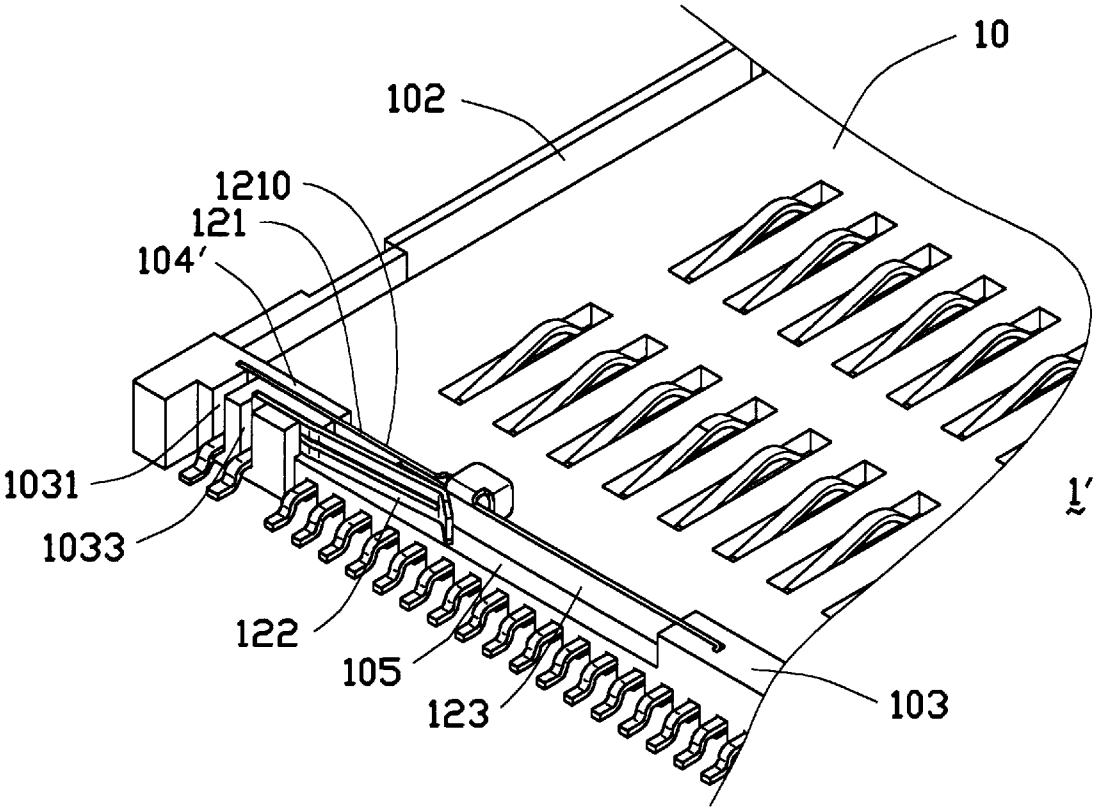
FIG. 4 is a view similar to FIG. 2, showing a card connector in accordance with a second embodiment of the present invention.
Figure 5:
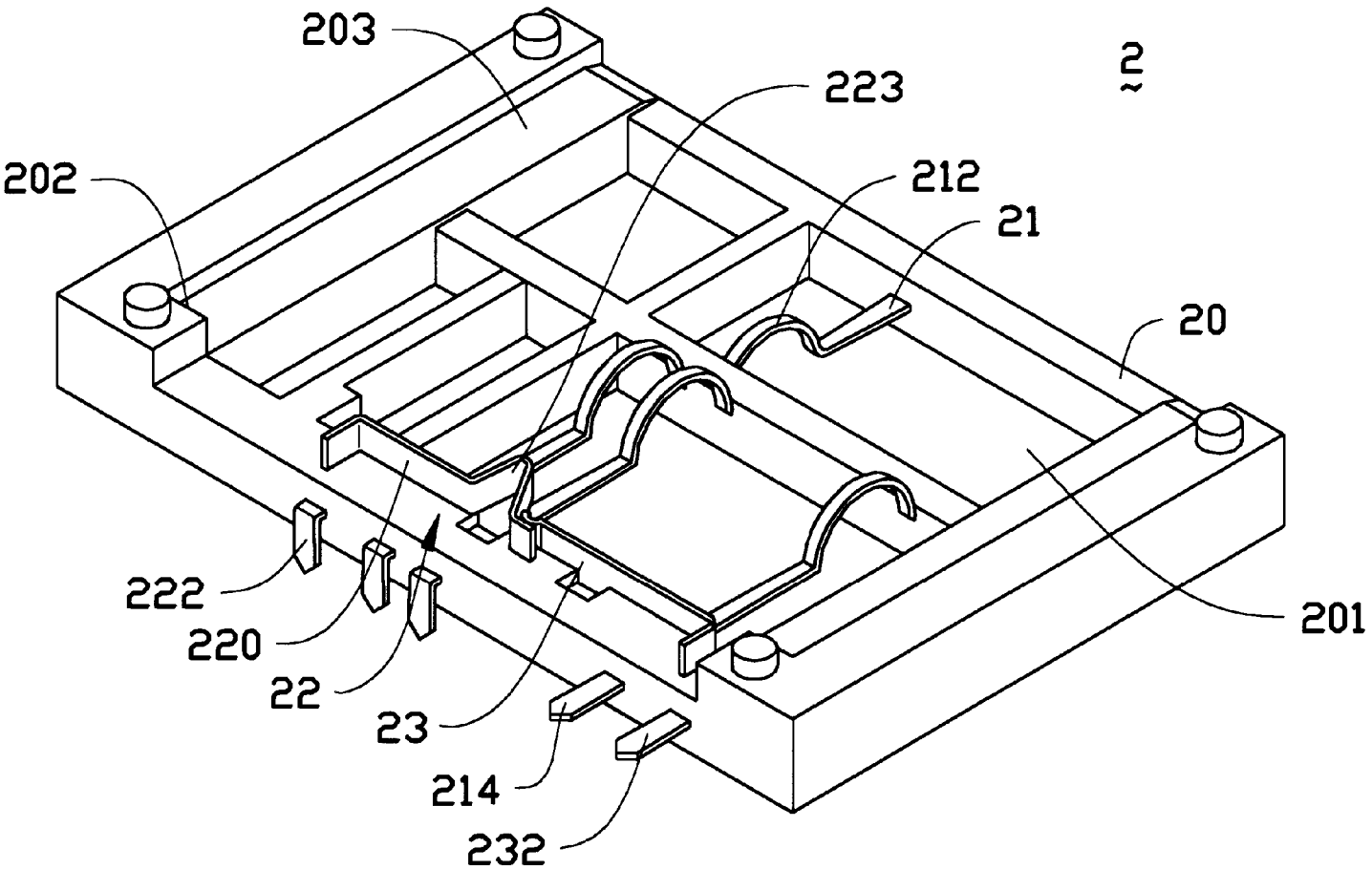
FIG.5 (PRIOR ART)
FIG. 5 is a perspective view showing a card connector in accordance with the prior art.
Figure 6:
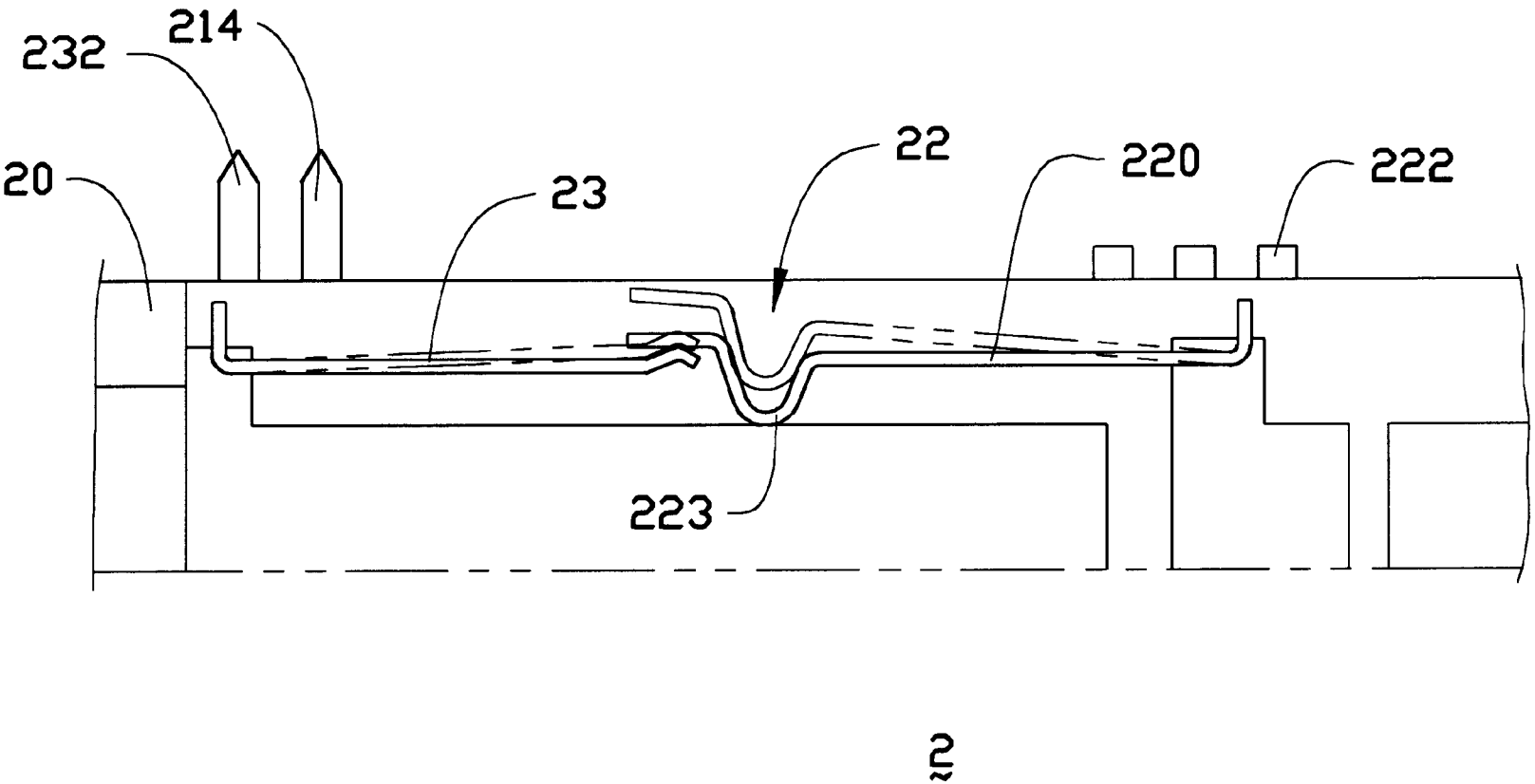
FIG.6 (PRIOR ART)
FIG. 6 is a partial top view of FIG. 5 showing a movement of a switch of the prior art connector.

FIG. 4 shows a card connector 1' in accordance with an alternative embodiment of the present invention wherein a second stop wall 104' has a smaller length than the second stop wall 104 of the first embodiment, whereby the body portion 1210 of the first conductive plate 121 is cantilevered. By such a design the reactive spring force of the second and third conductive plates 122, 123 acting on the first conductive plate 121 when the card 3 is withdrawn from the connector 1' can be absorbed by the resilience of the first conductive plate 121 thereby lessening the impact force acting on the first conductive plate 121 and preventing possible abrasion or scraping thereof caused by the impact force.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

I claim:

1. An electrical card connector, comprising:

a dielectric housing forming first and second lateral guiding walls for guiding an electrical card into the connector, a slot between the guiding walls for receiving the electrical card in the connector, a stop wall for engaging with an inserted card when the inserted card reaches the stop wall, and a number of contact passageways;

a number of reading contacts fixedly received in the contact passageways, each reading contact having a contact portion extending into the slot for electrically connecting with the inserted card and a tail portion for being soldered to a printed circuit board; and a switch comprising:

a first conductive member having an end fixed to the housing at a position near the first guiding wall, a free end extending toward the second guiding wall, and a tail portion extending from the fixed end for being soldered to the printed circuit board;

a second conductive member having an end fixed to the housing at a position near the first guiding wall, a free end extending toward the second guiding wall, and a tail portion extending from the fixed end for being soldered to the printed circuit board; and a third conductive member having an end fixed to the housing near the second guiding wall, a free end extending toward the first guiding wall between the first and second conductive members and contacting therewith, and an engaging tab extending into the slot for receiving a push force from the card inserted into the connector.

2. The connector in accordance with claim 1, wherein the second conductive member generates a reactive spring force which is larger than the force generated by the third conductive member when the engaging tab receives the push force from the card inserted into the connector.

3. The connector in accordance with claim 1, wherein the stop wall comprises a first stop member extending from the first guiding wall toward the second guiding wall, and a second stop member extending from the second guiding wall toward the first guiding wall and defining an opening with the first stop member, wherein the fixed end of the third conductive member is fixed to the second stop member and the engaging tab extends into the slot via the opening.

4. The connector in accordance with claim 3, wherein an L-shaped partition is located near the first stop member to define a first L-shaped channel therebetween, and a rectangular partition is located near the L-shaped partition to define a second L-shaped channel therebetween, the fixed end of the first conductive member being interferentially received in the first channel, and the fixed end of the second conductive member being interferentially received in the second channel.

5. The connector in accordance with claim 4, wherein the first conductive member has a body between the free and fixed ends thereof, the body abutting the first stop member.

6. The connector in accordance with claim 4, wherein the first conductive member has a body between the free and fixed ends thereof, the body projecting from the first stop member to form a cantilevered beam.

7. The connector in accordance with claim 1, wherein each guiding wall forms a hook for engaging with a shielding for protecting the reading contacts from electromagnetic interference.

8. A switch structure for use with a card connector having a dielectric housing with opposite first and second sides for guiding a card into the connector, said switch structure comprising:

a first conductive member with one fixed end secured to the first side of the dielectric housing of said connector and a free end extending toward the second side of the housing of said connector;

a second conductive member with one fixed end secured to the first side of the connector and a free end extending toward the second side of the connector; and a third conductive member with one fixed end secured to the second side of the connector and a free end extending toward the first side of the connector; wherein the free end of said third conductive member simultaneously contact both the first conductive member and the second conductive member to connect the first conductive member and the second conductive member when a card is not inserted into the connector, while the free end of said third conductive member can be pushed by an inserted card to disconnect the first conductive member and the second conductive member.

9. The switch structure in accordance with claim 8, wherein said first conductive member and said second conductive member are not directly mechanically engaged with each other.

10. The switch structure in accordance with claim 8, wherein said first conductive member includes a tail portion solderably mounted to a printed circuit board, and the second conductive member includes another tail portion solderably mounted to the same printed circuit board.

11. A switch structure for use with a card connector, comprising:

a first conductive member with one fixed end secured to a housing of said connector, and a free end opposite to said fixed end thereof;

a second conductive member with one fixed end secured to the housing of the connector, and a free end opposite to said fixed end thereof; and a third conductive member with one fixed end secured to the housing of the connector and a free end opposite to said fixed end thereof; wherein the free end of said third conductive member can be pushed backward by an inserted card to be disengaged from the free end of the first conductive member while still supportably engaged with the free end of the second conductive member to assure the third conductive member of resuming its original position to recapture the free end of the first conductive member when the card is removed from the connector.

* * * * *